US008434971B2

(12) United States Patent
Dawson et al.

(10) Patent No.: US 8,434,971 B2
(45) Date of Patent: May 7, 2013

(54) RETAINING WALL BLOCK WITH FACE CONNECTION

(75) Inventors: William B. Dawson, Medina, MN (US); Robert A. MacDonald, Plymouth, MN (US)

(73) Assignee: Contech Technologies, Inc., West Chester, OH (US)

( * ) Notice: Subject to any disclaimer, the term of this patent is extended or adjusted under 35 U.S.C. 154(b) by 0 days.

(21) Appl. No.: 13/430,107

(22) Filed: Mar. 26, 2012

(65) Prior Publication Data

US 2012/0183362 A1 Jul. 19, 2012

Related U.S. Application Data

(63) Continuation of application No. 11/284,151, filed on Nov. 21, 2005, now abandoned.

(60) Provisional application No. 60/630,898, filed on Nov. 24, 2004.

(51) Int. Cl.
*E02D 17/20* (2006.01)
*E04B 2/00* (2006.01)

(52) U.S. Cl.
USPC ..... 405/284; 405/286; 52/592.6; 52/604; 52/605

(58) Field of Classification Search ..... 405/284, 405/286; 52/604, 605, 592.6
See application file for complete search history.

(56) References Cited

U.S. PATENT DOCUMENTS

| | | | |
|---|---|---|---|
| 221,127 | A | 10/1879 | Walker |
| 2,313,363 | A | 3/1943 | Schmitt |
| 3,220,141 | A | 11/1965 | Goss, III |
| 4,035,975 | A | 7/1977 | Gergely |
| D255,787 | S | 7/1980 | Morehead, Jr. |
| 4,441,298 | A | 4/1984 | Limousin |
| 4,565,043 | A | 1/1986 | Mazzarese |
| 4,651,485 | A | 3/1987 | Osborne |
| 4,711,606 | A | 12/1987 | Leling et al. |
| 4,815,897 | A | 3/1989 | Risi et al. |
| 4,909,010 | A | 3/1990 | Gravier |
| 4,914,876 | A | 4/1990 | Forsberg |
| 4,964,761 | A | 10/1990 | Rossi |
| 5,214,898 | A | 6/1993 | Beretta |
| RE34,314 | E | 7/1993 | Forsberg |
| 5,294,216 | A | 3/1994 | Sievert |

(Continued)

FOREIGN PATENT DOCUMENTS

| | | | |
|---|---|---|---|
| CN | 86 1 06736 | A | 6/1988 |
| EP | 0 472 993 | A1 | 3/1992 |

OTHER PUBLICATIONS

Abstract for CN 86 1 06736 A (1 page).

(Continued)

*Primary Examiner* — Tara M. Pinnock
(74) *Attorney, Agent, or Firm* — Popovich, Wiles & O'Connell, P.A.

(57) ABSTRACT

Single and multiple retaining wall blocks and block systems in which the blocks are provided with a face connection system which includes at least one front lip extending from a top surface of the block and a bottom channel formed into a front face and bottom surface of the block. The front lips have a length which is equal to the width of the blocks.

20 Claims, 28 Drawing Sheets

U.S. PATENT DOCUMENTS

| | | | |
|---|---|---|---|
| 5,484,236 | A | 1/1996 | Gravier |
| D377,397 | S | 1/1997 | Craig |
| 5,623,797 | A | 4/1997 | Gravier et al. |
| 5,653,558 | A | 8/1997 | Price |
| 5,711,130 | A | 1/1998 | Shatley |
| 5,803,660 | A | 9/1998 | Warren et al. |
| 5,820,304 | A | 10/1998 | Sorheim et al. |
| D411,315 | S | 6/1999 | Bott |
| 5,943,827 | A | 8/1999 | Okerlund |
| 5,951,210 | A | 9/1999 | Maguire et al. |
| 5,960,604 | A | 10/1999 | Blanton |
| D416,627 | S | 11/1999 | McAllister |
| 6,019,550 | A | 2/2000 | Wrigley et al. |
| 6,082,067 | A | 7/2000 | Bott |
| 6,168,353 | B1 | 1/2001 | Price |
| 6,223,493 | B1 | 5/2001 | Ruggeri |
| 6,322,742 | B1 | 11/2001 | Bott |
| D459,487 | S | 6/2002 | Bott |
| 6,464,432 | B1 | 10/2002 | Shaw |
| 6,523,317 | B1 | 2/2003 | Bott et al. |
| 6,540,501 | B1 | 4/2003 | Bott |
| 6,651,401 | B2 | 11/2003 | Price et al. |
| 6,665,994 | B1 | 12/2003 | Ruggeri |
| 6,854,236 | B2 | 2/2005 | Bott |
| 7,185,470 | B1 | 3/2007 | Link |
| 7,207,146 | B1 * | 4/2007 | Morrell ..... 52/561 |
| 2005/0123362 | A1 | 6/2005 | Price et al. |
| 2006/0239784 | A1 | 10/2006 | Price et al. |

OTHER PUBLICATIONS

Jan. 23, 2009 First Office Action in corresponding Chinese patent application No. 200580039872.8 (11 pages).

Apr. 20, 2006 International Search Report for Application No. PCT/US2005/042253 (2 pages).

Apr. 20, 2006 Written Opinion of the International Searching Authority for Application No. PCT/US2005/042253 (6 pages).

* cited by examiner

RETAINING WALL BLOCK WITH FACE CONNECTION

This application is a continuation of U.S. Ser. No. 11/284,151, filed Nov. 21, 2005, which claims the benefit of U.S. Provisional Application No. 60/630,898, filed Nov. 24, 2004, the contents of each of which are hereby incorporated by reference herein.

FIELD OF INVENTION

The present invention relates to retaining wall blocks having a front face connection system and to retaining walls constructed from those blocks and to methods of making the blocks and constructing walls from the blocks.

BACKGROUND OF THE INVENTION

Numerous methods and materials exist for the construction of retaining walls. Such methods include the use of natural stone, pored in place concrete, masonry, and landscape timbers or railroad ties. In recent years, segmental concrete retaining wall units which are dry stacked (i.e., built without the use of mortar, have become a widely accepted product for the construction of retaining walls. Such products have gained popularity because they are mass produced, and thus relatively inexpensive. They are structurally sound, easy and relatively inexpensive to install, and couple the durability of concrete with the attractiveness of various architectural finishes.

When constructing a retaining wall it is desirable to utilize some form of connection system between the blocks for the purpose of stabilizing and aligning the wall. For example, the retaining wall system described in U.S. Pat. No. RE 34,314 includes a block design that incorporates, among other elements, a system of pins that interlock and align the retaining wall units, allowing structural strength and relatively quick installation. The system may be adapted for the construction of large walls by employing geogrids which can be hooked over the pins. Such a system is described in U.S. Pat. No. 4,914,876 (Forsberg).

Other connection systems make use of the shape of the block itself for interlock and connection. For example, numerous block designs have used a sheer connector embodied in the blocks shape to align the blocks with a setback, or batter. A common form of such sheer connectors is a rear, downwardly projecting lip or flange. In forming a multi course wall, the blocks are placed such that the flanges contact the upper back edge of the blocks located in the course below. As such, blocks having flanges are caused to become aligned with the blocks positioned below, while at the same time providing a degree of resistance against displacement of individual blocks by earth pressures. In walls formed using blocks of this type, the rear flanges of the blocks create a setback between block courses and cause the wall to slope backward at an angle which is predetermined by the width of the flanges.

Retaining walls using blocks having a rear flange are well known in the art. For example, U.S. Pat. No. 2,313,363 (Schmitt) describes an early use of a retaining wall block with a rear flange. More recently, U.S. Pat. No. 5,294,216 (Sievert) describes a geogrid reinforced retaining wall constructed with retaining wall blocks having rear flanges. Such blocks function adequately for small walls where soil reinforcement is not necessary because they are relatively simple to install and require no special pieces for capping the top course of the wall.

One disadvantage of using blocks having a rear flange is that their use naturally creates a setback between courses which produces a visible line or seam between courses which is noticeable to an observer. In other words, the visual appearance of the wall is such that an observer tends to notice not only the vertical lines between blocks in a course but also the lines at the top and bottom of blocks in each course. Thus, each block in the wall is identifiable as a separate unit from the adjacent blocks. In certain circumstances this may create the desired aesthetic affect. However, in other situations it is desirable to create a more random visual appearance where each block is not separately identifiable.

Retaining walls using blocks having a continuous front flange which extend the entire width of the block are also well known in the art. For Example, U.S. Pat. No. 5,484,236 (Gravier) describes a block with a continuous front flange or lip located at the top of the block and a lateral front notch located at the bottom of the block. The notch is located along the bottom of the front face of the block and is designed to receive the lip of an adjacent block in a lower course of the retaining wall. As with rear flanged blocks, there are disadvantages of prior art continuous front flanged blocks. First, their use naturally creates a set back that accentuates the horizontal lines between succeeding courses of the retaining wall. Second, the continuous flange on these blocks makes it difficult to form smooth inside or outside curves in a wall formed from the blocks. Third, because the flange of a front (or rear) flanged block extends in a straight line across the entire width of the block, the blocks tend to set back excessively when a curve in the wall is constructed.

Thus, a need exists in the art for a retaining wall block and block system which can be used to construct a retaining wall having a connection system which provides for the necessary safety and stability of the wall yet also creates a random or variable visual appearance for the face of the wall and eases the construction of curves by maintaining a desired amount of setback when a curve is constructed.

SUMMARY OF THE INVENTION

The invention comprises first and second wall block systems which include face connection systems which allow for construction of a wall providing safety and stability as well as a desired face appearance.

In a first aspect the invention is a wall block comprising a block body including a top surface, a bottom surface and a front face. The front face has a height and a width. At least one lip extends from the top surface, the at least one lip having first and second ends, first and second lateral surfaces and an upper surface. One of the lateral surfaces forms a part of the front face. The lip has a length measured between the first and second ends, the length of the lip being less than the width of the front face. At least one channel is formed into the bottom surface and front face, the at least one channel being sized such that when a wall is formed from a plurality of the blocks stacked in multiple courses the at least one channel will accommodate a lip from an adjacent block in a lower course. The block body may further comprise first and second opposing side surfaces and a rear surface which opposes the front face. The first and second sides may be nonparallel. Further, the at least one channel may comprise a first channel and a second channel and the at least one lip may comprise a first lip and a second lip.

In another aspect the invention comprises a wall block system having a plurality of blocks including first and second blocks. Each block has a block body including a top surface, a bottom surface and a front face having a height and a width.

Each block further has a lip extending from the top surface and a channel formed into the bottom surface and front face, the lip having first and second ends, first and second lateral surfaces and an upper surface. One of the lateral surfaces forms a part of the front face. The lip has a length as measured between the first and second ends, the length of the lip being less than the width of the front face. The channel is sized such that when a wall is formed from the plurality of blocks stacked in multiple courses at least a portion of the lip of the first block positioned in a first course will be accommodated in the channel of the second block in a second course overlying the first course.

Another aspect of the invention is directed to a method of making a retaining wall. The method comprises providing a plurality of blocks including first, second and third blocks, each block having a block body including a top surface, a bottom surface and a front face having a height and a width. Each block further has a lip extending from the top surface and at least one channel formed into the bottom surface and front face, the lip having first and second ends, first and second lateral surfaces and an upper surface. One of the lateral surfaces forms a part of the front face. The lip has a length as measured between the first and second ends, the length of the lip being less than the width of the front face. The method includes laying the blocks in a first lower course including laying a first block adjacent to a second block. The method further includes laying the blocks in a second upper course in a running bond pattern over the first course, the third block overlying a portion of the first block and a portion of the second block, the at least one channel of the third block accommodating at least a portion of the lip of the first block and at least a portion of the lip of the second block.

A further aspect of the invention is a retaining wall system comprising a plurality of block types including a first block type and a second block type. Each block type has a block body including a top surface, a bottom surface and a front face having a height and a width. Each block type further has a lip extending from the top surface and a channel formed into the bottom surface and front face. The lip has first and second ends, first and second lateral surfaces and an upper surface. One of the lateral surfaces forms a part of the front face. The lip has a length as measured between the first and second ends. At least one of the first block type and second block type include a lip having a length which is less than the width of the front face. The retaining wall system may further comprise a third block type and a fourth block type.

In another aspect the invention is a method of making a retaining wall comprising providing a plurality of block types including a first block type and a second block type. Each block type has a block body including a top surface, a bottom surface and a front face having a height and a width. Each block type further has a lip extending from the top surface and a channel formed into the bottom surface and front face. The lip has first and second ends, first and second lateral surfaces and an upper surface. One of the lateral surfaces forms a part of the front face. The lip has a length as measured between the first and second ends. At least one of the first block type and second block type include a lip having a length which is less than the width of the front face. The method includes laying a plurality of first block types and second block types in a random pattern in multiple courses including a first lower course and a second upper course such that the channels of first block types and second block types in the second upper course receive lips of first block types and second block types in the first lower course.

In a further aspect the invention is a retaining wall block system comprising multiple blocks which may include first, second, third and fourth blocks. The first block has a block body including a top surface, a bottom surface and a front face. The first block further has a lip extending from the top surface and a channel formed into the bottom surface and front face, the lip having first and second ends, first and second lateral surfaces and an upper surface, one of the lateral surfaces forming a part of the front face. The second block has a block body including a top surface, a bottom surface and a front face. The second block further has first and second lips extending from the top surface and a channel formed into the bottom surface and front face, the first and second lips each having first and second ends, first and second lateral surfaces and an upper surface, one of the lateral surfaces of each of the first and second lips forming a part of the front face. The third block has a block body including a top surface, a bottom surface and a front face. The third block further has a lip extending from the top surface and a channel formed into the bottom surface and front face, the lip having first and second ends, first and second lateral surfaces and an upper surface, one of the lateral surfaces of the lip forming a part of the front face. The fourth block has a block body including a top surface, a bottom surface and a front face. The fourth block further having first and second lips extending from the top surface and a channel formed into the bottom surface and front face, the first and second lips each having first and second ends, first and second lateral surfaces and an upper surface, one of the lateral surfaces of each of the first and second lips forming a part of the front face.

Another aspect of the invention is a method of making a retaining wall. The method comprises providing a plurality of first blocks having a block body including a top surface, a bottom surface and a front face. The first blocks further having a lip extending from the top surface and a channel formed into the bottom surface and front face, the lip having first and second ends, first and second lateral surfaces and an upper surface, one of the lateral surfaces forming a part of the front face. The method further comprises providing a plurality of second blocks having a block body including a top surface, a bottom surface and a front face, the second blocks further having first and second lips extending from the top surface and a channel formed into the bottom surface and front face, the first and second lips each having first and second ends, first and second lateral surfaces and an upper surface, one of the lateral surfaces of each of the first and second lips forming a part of the front face. The method includes providing a plurality of third blocks having a block body including a top surface, a bottom surface and a front face, the third blocks further having a lip extending from the top surface and a channel formed into the bottom surface and front face, the lip having first and second ends, first and second lateral surfaces and an upper surface, one of the lateral surfaces of the lip forming a part of the front face. Further, the method includes providing a plurality of fourth blocks having a block body including a top surface, a bottom surface and a front face, the fourth blocks further having first and second lips extending from the top surface and a channel formed into the bottom surface and front face, the first and second lips each having first and second ends, first and second lateral surfaces and an upper surface, one of the lateral surfaces of each of the first and second lips forming a part of the front face. The wall is formed by laying the first, second, third, and fourth blocks in a random pattern in multiple courses including a first lower course and a second upper course such that the channels of blocks in the second upper course receive lips of blocks in the first lower course.

DETAILED DESCRIPTION OF THE PREFERRED EMBODIMENTS

Figure 1A:
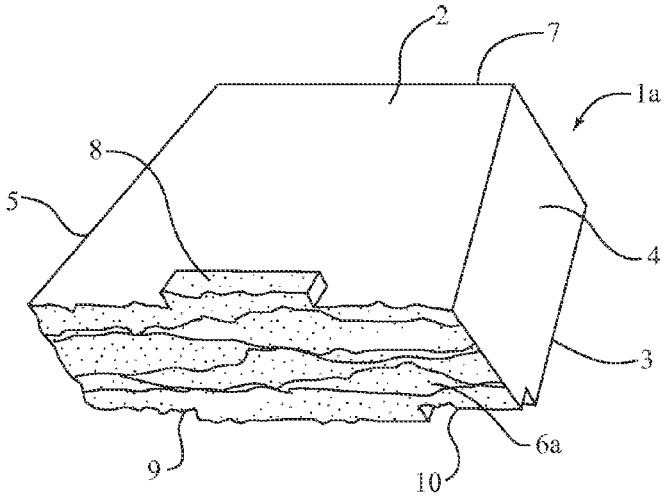
FIGS. 1A, 1B, 1C, 1D, 1E, 1F and 1G are perspective, top, front, right side, back, left side and bottom views, respectively, of a block according to a first embodiment of a single block system in accordance with the present invention.
Figure 1B:
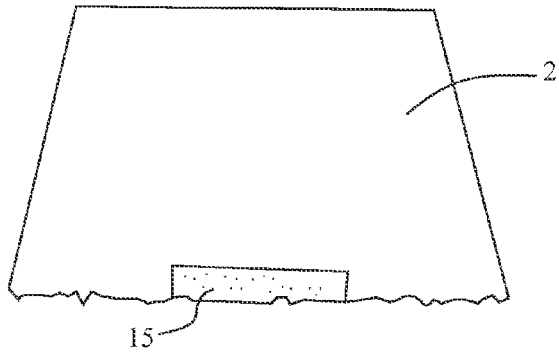
Figure 1C:
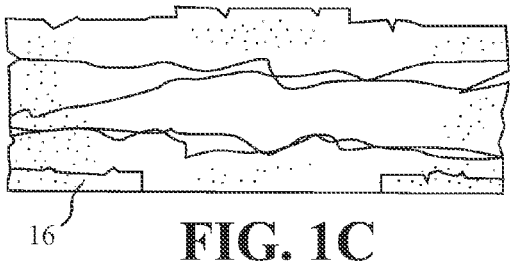
Figure 1D:
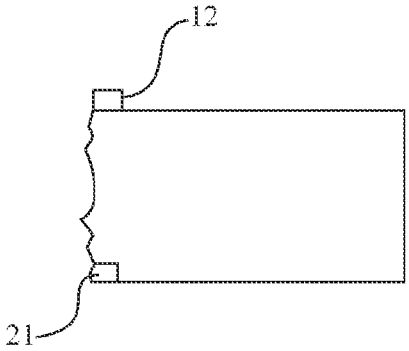
Figure 1E:
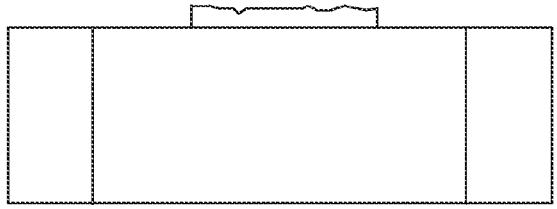
Figure 1F:
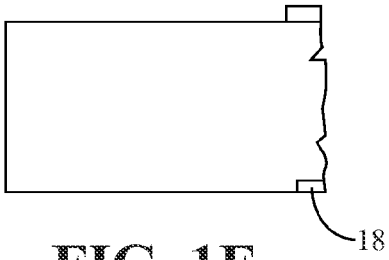
Figure 1G:
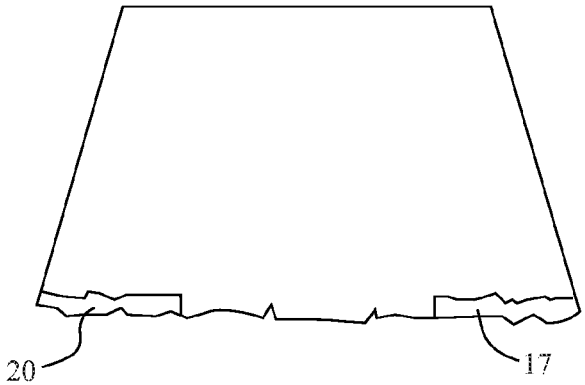

In this application, "upper" and "lower" refer to the placement of the block in a retaining wall. The lower surface faces down, that is, it is placed such that it faces the ground. In forming a retaining wall, one row of blocks is laid down, forming a course. A second course is laid on top of this by positioning the lower surface of one block on the upper surface of another block.

The blocks of this invention may be made of a rugged, weather resistant material, such as concrete, especially if the wall is constructed outdoors. Other suitable materials include plastic, reinforced fibers, and any other materials suitable for use in molding wall blocks. The surface of the blocks may be smooth or may have a roughened appearance, such as that of natural stone. In some embodiments the front surface or faces of the blocks are provided with an ashlar pattern and in others a ledgestone pattern. The blocks may be formed in a mold which is equipped to impart various textures on the front face of the blocks.

The Figures describe various block embodiments. Many elements in various block embodiments are identical in shape, size, relative placement, and function, and therefore the numbers for these elements do not change. Elements that vary from one block embodiment to another are identified by suffixes "a", "b", "c", etc. and may be referred to in a general way by a number without its suffix.

The blocks of this invention as illustrated in the drawing figures are generally symmetrical about a vertical plane of symmetry. However, it should be understood that the shape of the block is not critical to the invention. Specifically, any block shape which can be constructed to utilize the advantages of the front face connection system disclosed herein will fall within the scope of this invention. Similarly, although several embodiments of the surface texture of the front face of the blocks are disclosed it should be understood that those embodiments are not meant to be limiting and that any desired front face surface texture can be utilized within the scope of the present invention. Further, although the blocks are shown having a solid block body it will be appreciated that the blocks could be formed with a core, especially if it is desired to reduce the weight of the blocks or the amount of material required to make the blocks.

The novel block connection system of the present invention can be incorporated into various retaining wall block systems. Disclosed herein are two block systems incorporating the present invention, both systems having multiple embodiments. The first block system shown in FIGS. 1 to 5 comprises a single block which incorporates the face connection system disclosed herein. The face connection system comprises one or more upper lips extending from the top surface of the block (which do not extend across the entire extent of the width of the face) and one or more lower channels formed along the bottom of the blocks face, which may, or may not, extend across the entire extent of the width of the face, depending on the preferred embodiment. The term "single block system" refers to the use of a plurality of blocks, each having an identical lip and channel configuration although the surface texture of the front face of the block may be varied. A plurality of these blocks are used to construct a retaining wall. Two embodiments of this block are disclosed. A first embodiment shown in FIGS. 1A to 1G has a ledgestone front surface texture. A second embodiment shown in FIGS. 4A to 4G has an ashlar surface texture. It will be appreciated that although not disclosed other surface texture embodiments would work equally well with the present invention such as smooth surfaces or surface textures that simulate natural stone, brick, or any other surface texture known to those of skill in the art.

A second block system for constructing a retaining wall is disclosed in FIGS. 6 to 16. This system is a multiple block system which utilizes more than one version of wall block incorporating the front face connection system of the present invention. In other words the multiple block system uses blocks wherein the placement and/or size of the lips is not identical. Although the system disclosed illustrates the use of multiples of four such blocks, each having a different lip configuration, it should be understood that a multiple block system of this nature could be used in a two block system, a three block system or any other multiple block system which incorporates more than one version of a retaining wall block having the present front face connection system.

Single Block System

The single block wall system is shown in FIGS. 1 to 5. A first embodiment of the block is shown in FIGS. 1A to 1G which illustrate perspective, top, front, right side, back, left side and bottom views, respectively, of block la. Block la has a top surface 2 which is substantially parallel to a bottom surface 3, nonparallel first and second side wall surfaces 4 and 5, and a front face 6*a* which is substantially parallel to a rear surface 7. The front face 6*a* and rear surface 7 each extend from top surface 2 to bottom surface 3. First and second side surfaces 4 and 5 extend from top surface 2 to bottom surface 3 and from front face 6*a* to rear surface 7. The top and bottom surfaces, side surfaces, front face and rear surface collectively define a block body. The size of the bocks may be similar to presently used retaining wall blocks. By way of non limiting example the blocks may be between 12-18 inches wide, 7-12 inches deep and 3-8 inches in height. Block 1*a* is generally symmetrical about a vertical plane of symmetry. As shown block 1*a* is generally wedge shaped. However, as mentioned previously, other block shapes could be utilized within the scope of the invention including square, rectangular, or shapes characterized by nonparallel side surfaces such as a configuration where one of the side surfaces is orthogonal to the front face.

Figure 3:
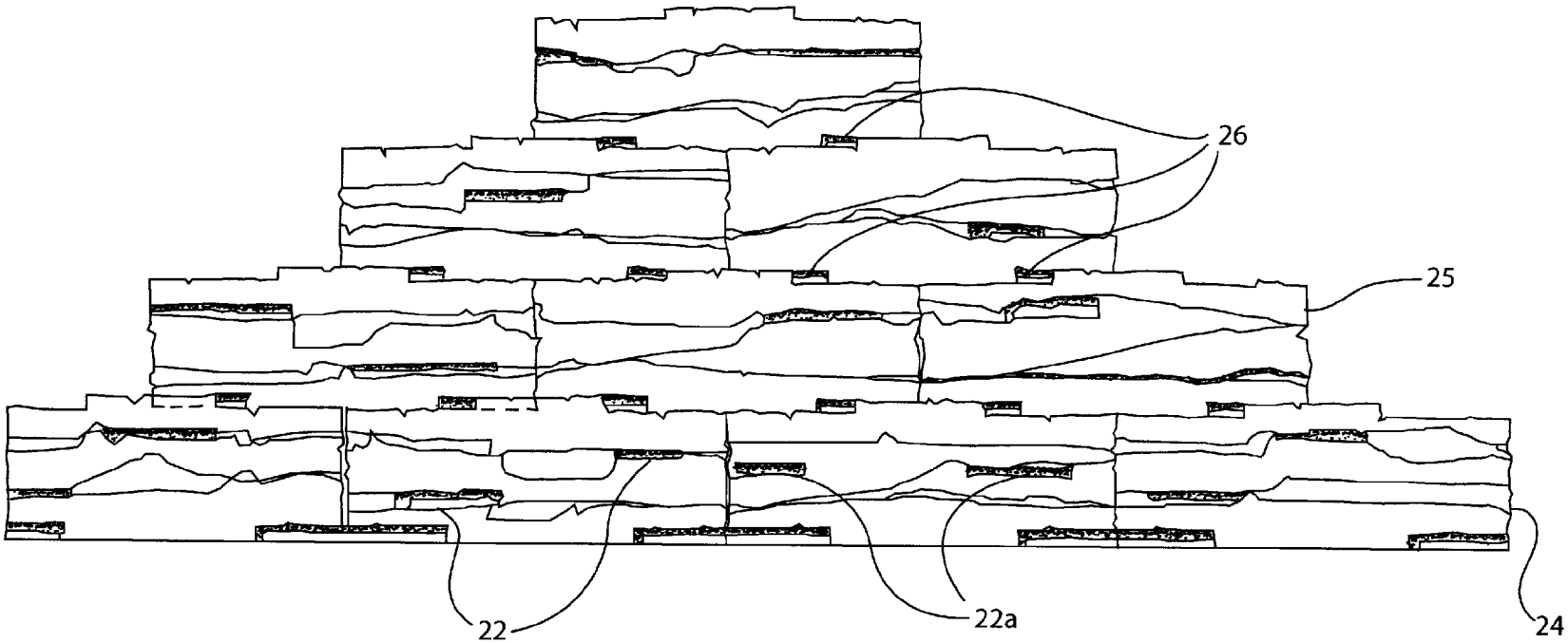
FIG. 3 is a front view of a portion of a retaining wall constructed with the block of FIG. 1.
Figure 4A:
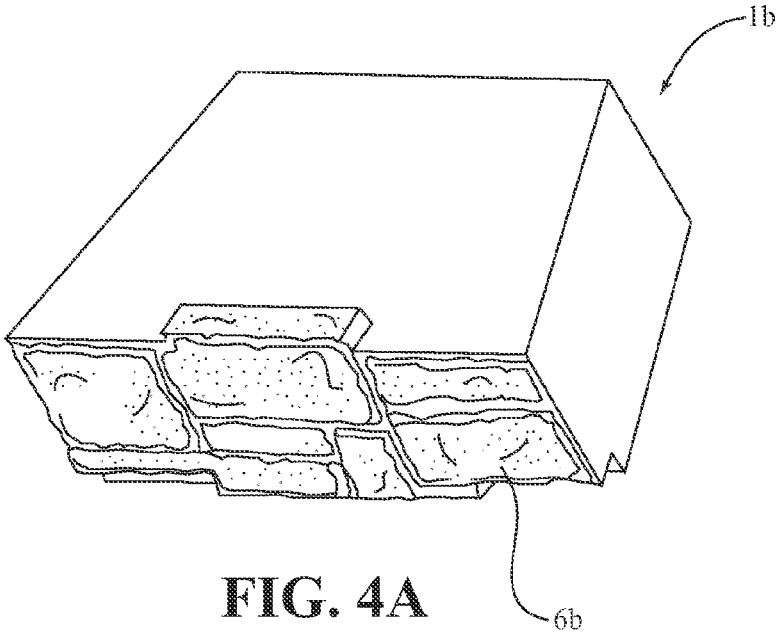
FIGS. 4A, 4B, 4C, 4D, 4E, 4F and 4G are perspective, top, front, right side, back, left side and bottom views, respectively, of a block according to a second embodiment of a single block system in accordance with the present invention.
Figure 4B:
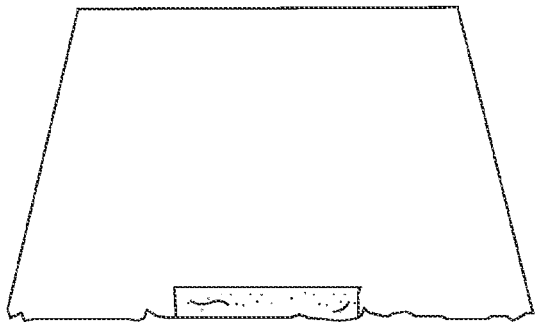
Figure 4C:
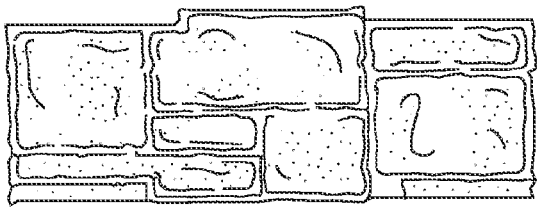
Figure 4D:
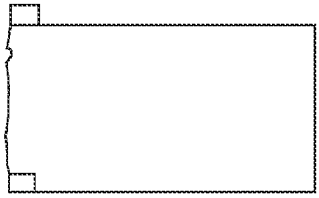
Figure 4E:
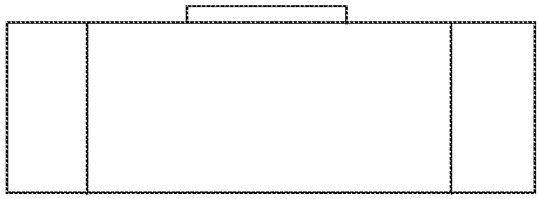
Figure 4F:
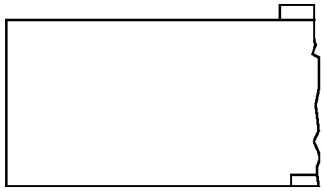
Figure 4G:
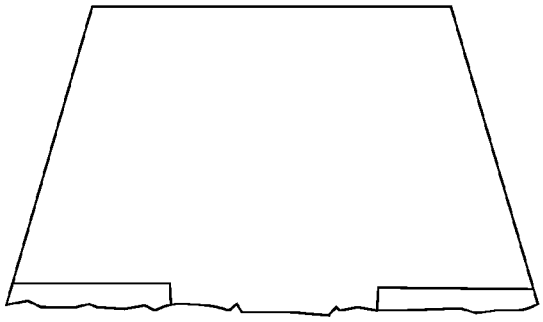

When block 1*a* is utilized to construct a retaining wall, a portion of which is shown in FIG. 3, the block is laid in multiple courses in a running bond pattern. The connection system which stabilizes the wall comprises a lip 8 extending from the top surface 2 of the block and channels 9 and 10 formed in the front face 6*a* of the block. Lip 8 comprises a front surface portion 11 which forms a portion of front face 6*a*, a rear surface portion 12 with side surface portions 13 and 14 and top surface portion 15 extending therebetween. The lips will be properly sized to be received in the channels and create the desired setback between courses. By way of non limiting example the width of the lip as measured between the front surface portion and the rear surface portion may be ¾ inch. The height of the lip as measured between the top surface 2 of block 1*a* and top surface portion 15 may be ¼ inch.

Channels 9 and 10 generally form recesses in front face 6*a* along bottom surface 3 of block 1*a*. Channel 9 is defined by a face surface portion 16, a top surface portion 17 and an end surface portion 18. Similarly, channel 10 is defined by face surface portion 19, top surface portion 20 and end surface portion 21. The size of channels 9 and 10 will be selected to receive lip 8 and to produce, in connection with lip 8, the desired setback. By way of non limiting example the height of channels 9 and 10 as measured between bottom surface 3 and top surfaces 17 and 20 may be 5/16 inch. The depth of channels 9 and 10 as measured between front face 6*a* and face surface portions 16 and 19 may be ½ inch.

Figure 2:
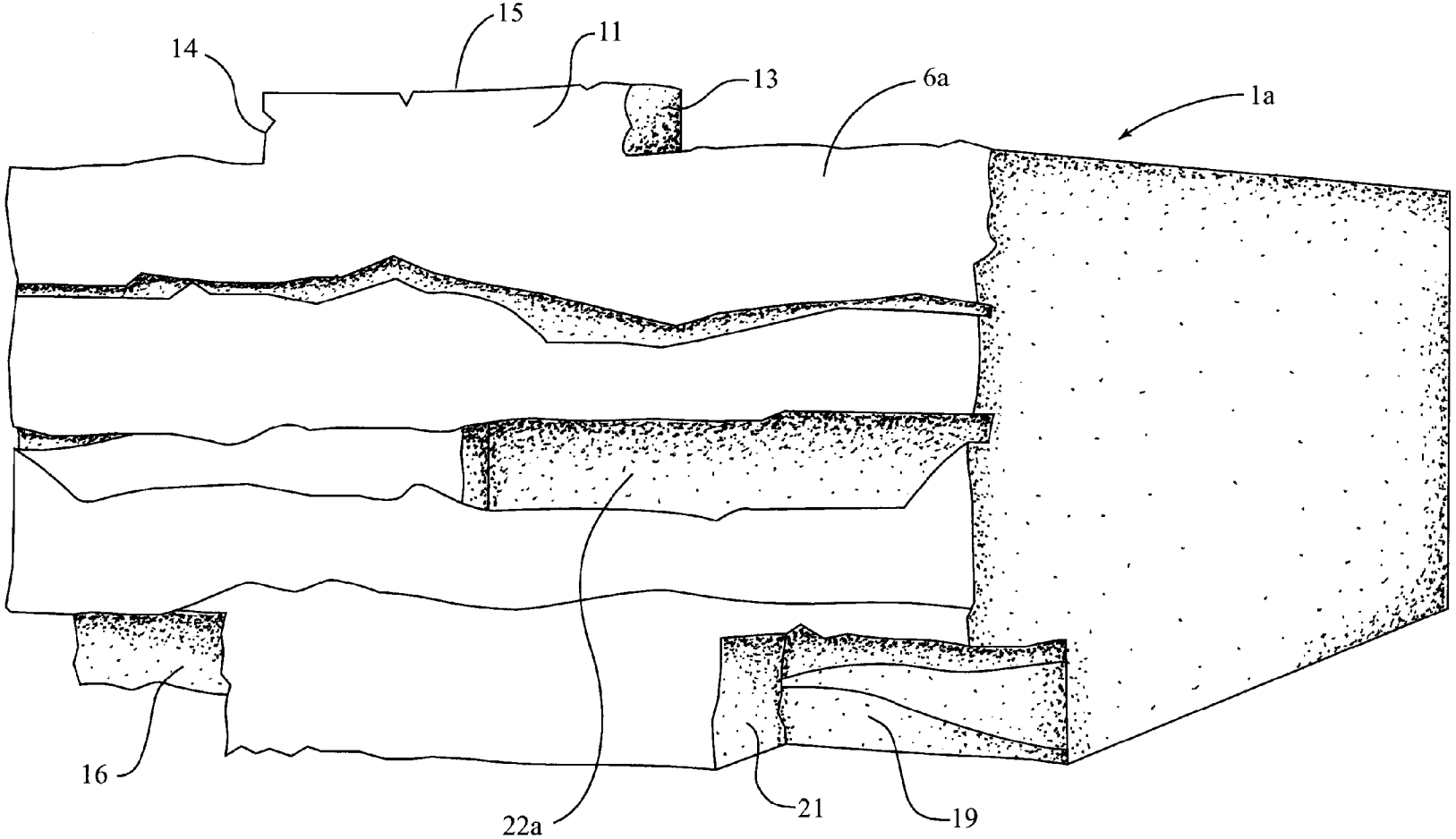
FIG. 2 is an enlarged perspective view of the front face and right side of the block of FIG. 1.

FIG. 2 is an enlarged drawing of block 1*a* for the purpose of showing the features of the block in more detail and specifically the surface contour and texture of front face 6*a*. From FIG. 2 it is apparent that front face 6*a* is provided with a contoured surface texture which includes ridges which may extend outwardly from front face 6*a* as well as indentations or recesses which extend into front face 6*a* towards rear surface 7. In particular, front face 6*a* may be provided with one or more recesses 22*a*. In this embodiment recess 22*a* is formed in the shape of an elongate slot. As will be described in more detail hereafter the purpose of slot 22*a* is to provide a surface contour to the front face of a retaining wall which is built from blocks 1*a* which tends to hide or camouflage any regular pattern which is created by portions of exposed channels 9 and 10.

Figure 17:
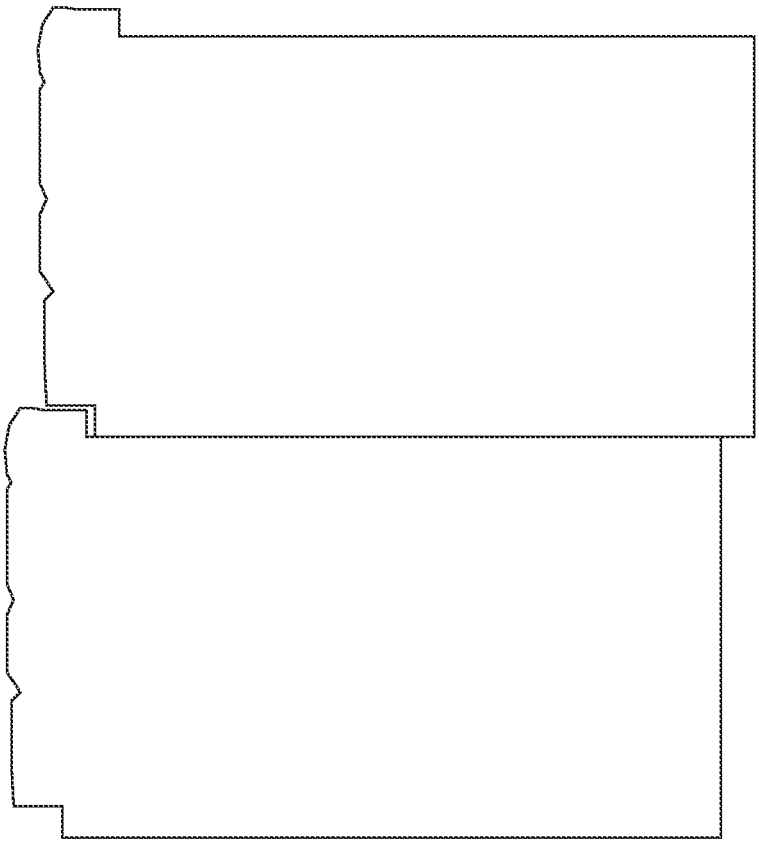
FIG. 17 is a side view of first and second blocks according to the invention which are stacked one over the other to illustrate the face connection system.
Figure 18:
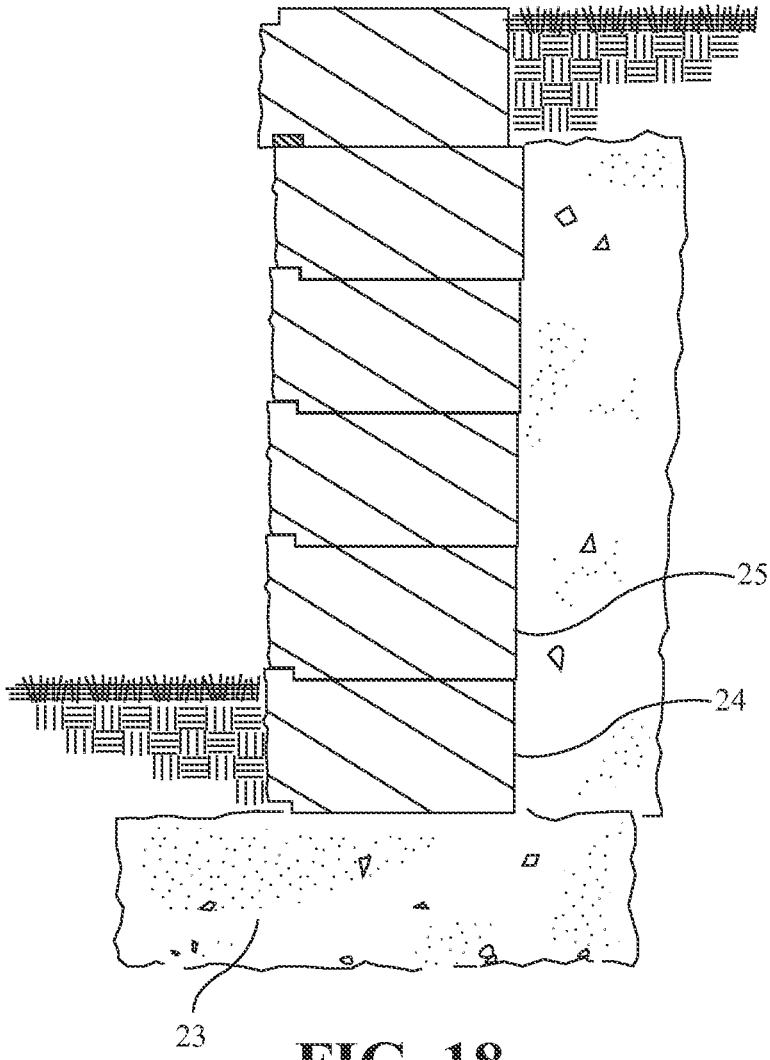
FIG. 18 is a side view of a multiple course retaining wall constructed in accordance with the invention.

The method of constructing a retaining wall with blocks 1*a* can best be understood with reference to FIGS. 3, 17 and 18. After forming a sufficient base leveling pad 23 in a manner well known to those of skill in the art a first course 24 of blocks is laid. Thereafter a second course 25 is stacked on the first course in a running bond pattern. The lips extending from the tops of blocks in the first course are received within the channels formed in the lower front surface of the blocks in the second course. Since the width of the lips as measured between the front surface portion and rear surface portions is greater than the depth of the channels as measured between front face 6*a* and face portions 16 and 19 an offset is created between courses. This causes the wall to set back in a rearward direction in an amount determined by the difference between the width of the lip and the depth of the channels.

As best seen in FIG. 3 the horizontal length of the combined channel formed by channels 16 and 19 of adjacent blocks in a course is greater than the horizontal length of the lip received therein as measured between the lip side surface portions. This results in portions of the channels 26 being visually exposed. It is necessary that the combined length of the channel formed by adjacent blocks is longer than the length of the lips for at least two reasons. First, when constructing a wall having an inside curve the channel formed between adjacent blocks will be pinched or shortened but must still be large enough in that state to receive a lip. Second, anytime a curved wall is built having a setback between courses some misalignment of the running bond pattern between courses is created. This requires that additional length be available in the channel to accommodate this misalignment.

In order to camouflage any regular pattern which is created by exposed portions 26 of the channels the blocks may be provided with recesses 22*a* as previously described in connection with FIG. 2. These recesses may be formed such that their surfaces are textured to resembled natural stone patterns in order to enhance the natural look of the finished wall. The single block wall system can also be made so that the configuration of the side and top surfaces of the lips and recesses are slightly varied (without affecting their location or overall dimensions significantly) among different blocks to create a more random and natural visual impression These recesses extend into the front face 6*a* to a depth sufficient to mimic the visual appearance of a partially exposed channel 26. Thus, any regular pattern which would be created by the exposed portions 26 is camouflaged by the random visual appearance added by recesses 22*a*.

Although this single block wall system can be comprised of the use of a single block la having an identical surface texture such as shown in FIG. 2 the randomness of the wall surface appearance is further enhanced by providing block 1*a* with a number of surface texture variations which can include varying the location and number of recesses 22*a* per block. Such variation in the surface contour and texture is efficiently created at the time the blocks are manufactured. One efficient manner of forming blocks 1*a* is with the use of a mold similar to that shown in FIG. 10 and described hereafter with respect to the multiple block wall system. If the blocks are manufactured according to this method each one of the four blocks in the mold can be formed with a different surface pattern or texture, all in the ledgestone style. Alternatively two could have a first surface texture and two could have a second surface texture. The result is that the single block wall system described herein can be formed with up to 4 (or more) surface variations which can be laid randomly to construct a retaining wall having a varied and random surface texture in which any regular pattern formed by exposed channel portions is effectively camouflaged.

To further enhance the visual appearance of the retaining wall the exposed surfaces of the lips and channels can be provided with some surface contour. Specifically, the top surface 15 and side surfaces 13 and 14 of the lip can be textured. Additionally, the face surface portion, top surface portion and end surface portion of channels 9 and 10 can be textured. Preferably, the texture of the surface portions of the lip and channel is created with contour formed into the body of the block and not extending from the body of the block so that no interference is created which would affect the manner in which the lip is received by the channels or the amount of block setback.

Figure 5:
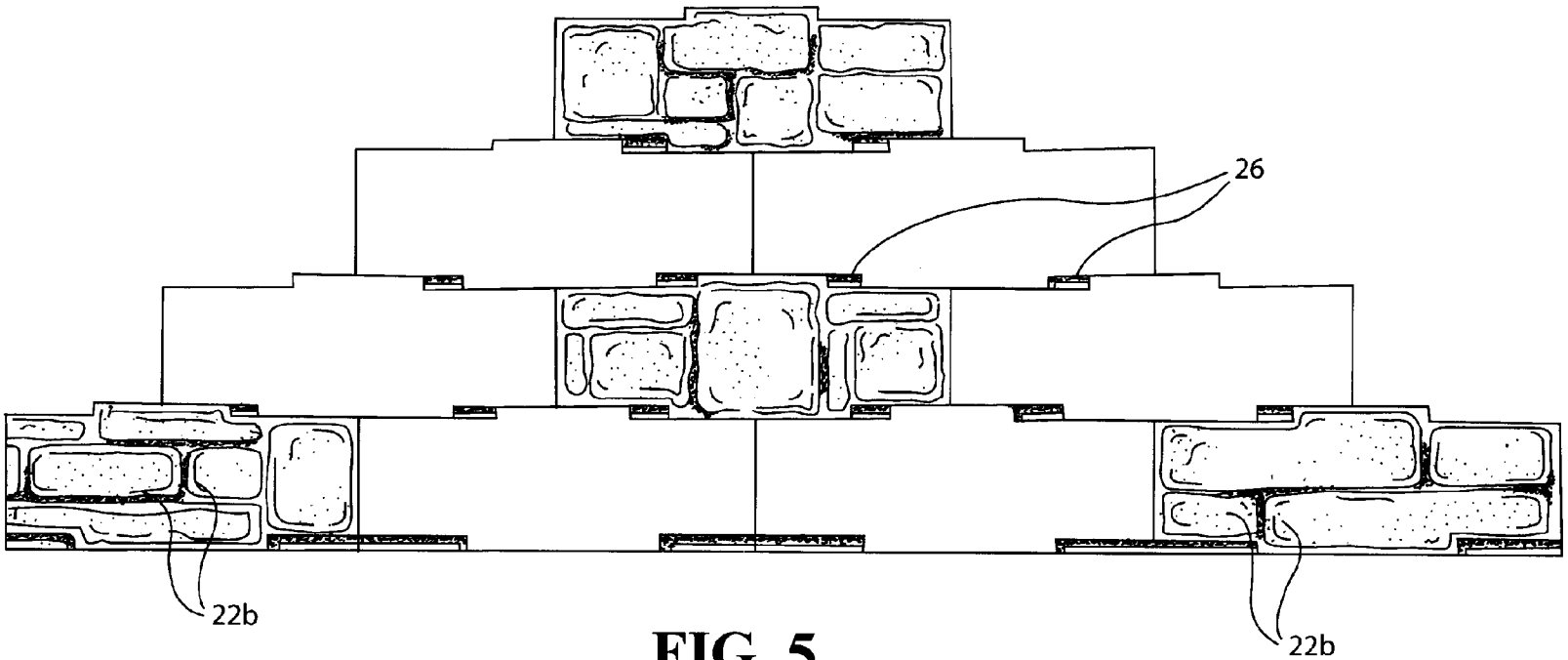
FIG. 5 is a front view of a portion of a retaining wall constructed with the block of FIG. 4.
Figure 6A:
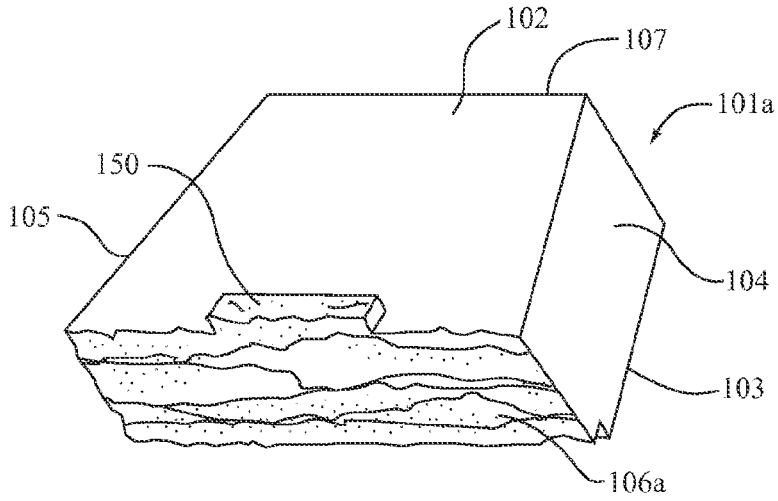
FIGS. 6A, 6B, 6C, 6D, 6E, 6F and 6G are perspective, top, front, right side, back, left side and bottom views, respectively, of a first block according to a first embodiment of a multiple block system in accordance with the present invention.
Figure 6B:
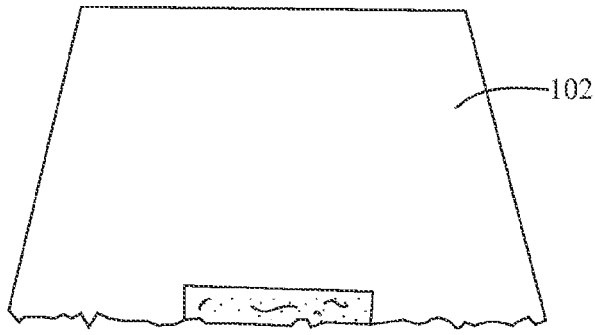
Figure 6C:
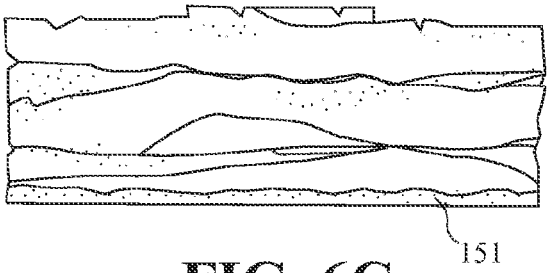
Figure 6D:
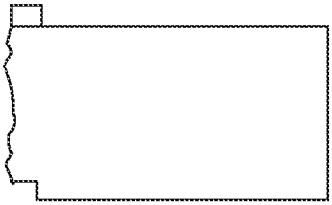
Figure 6E:
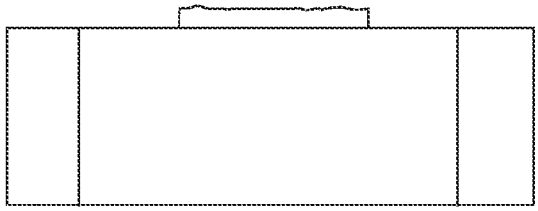
Figure 6F:
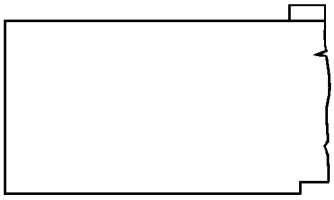
Figure 6G:
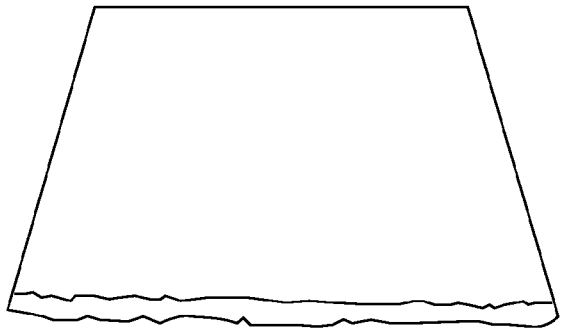
Figure 7A:
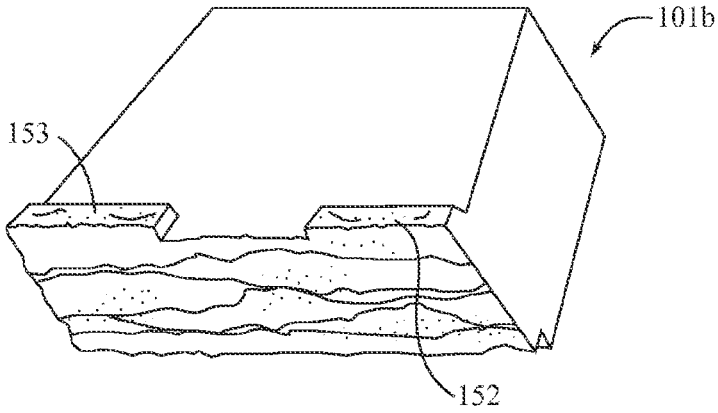
FIGS. 7A, 7B, 7C, 7D, 7E, 7F and 7G are perspective, top, front, right side, back, left side and bottom views, respectively, of a second block according to a first embodiment of a multiple block system in accordance with the present invention.
Figure 7B:
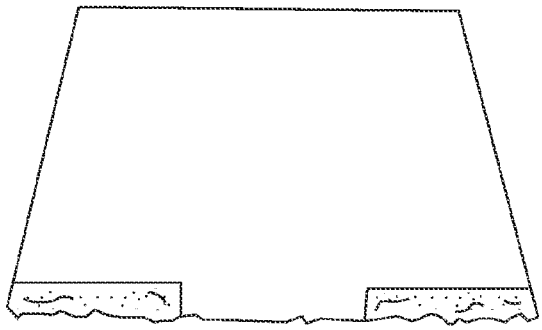
Figure 7C:
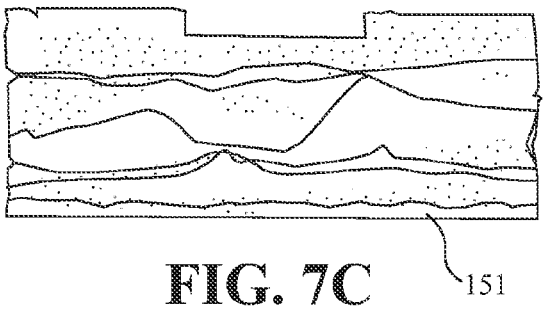
Figure 7D:
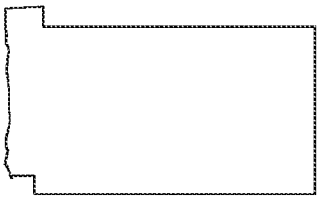
Figure 7E:
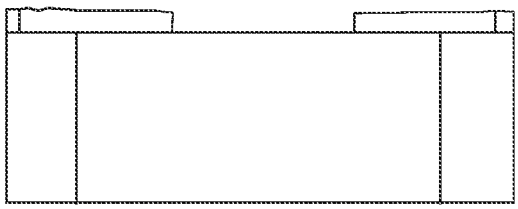
Figure 7F:
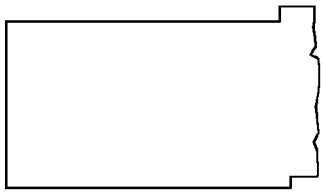
Figure 7G:
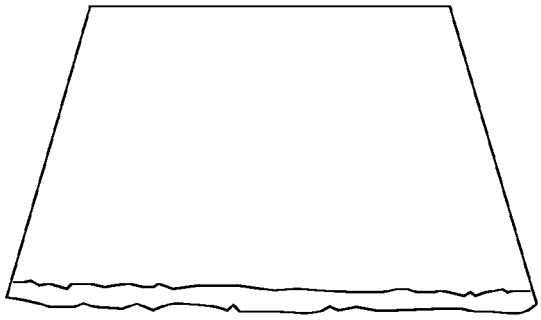
Figure 8A:
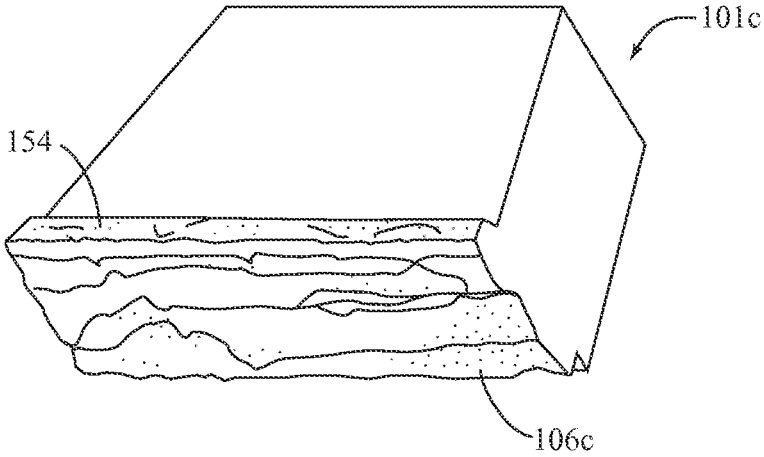
FIGS. 8A, 8B, 8C, 8D, 8E, 8F and 8G are perspective, top, front, right side, back, left side and bottom views, respectively, of a third block according to a first embodiment of a multiple block system in accordance with the present invention.
Figure 8B:
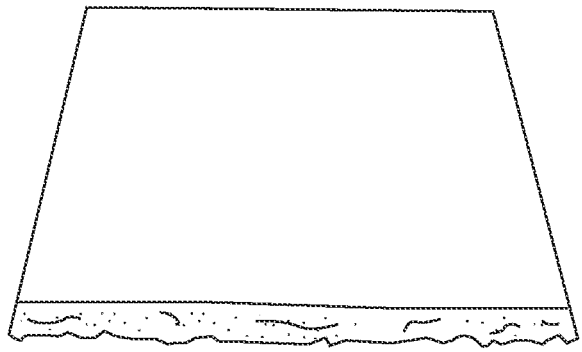
Figure 8C:
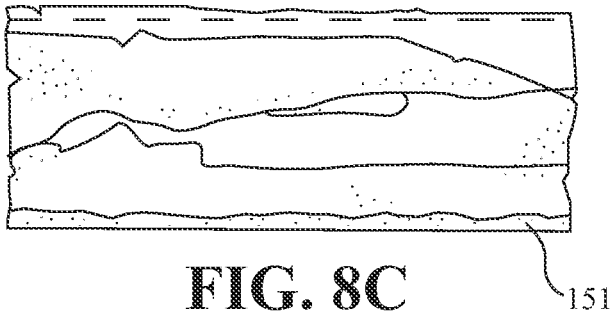
Figure 8D:
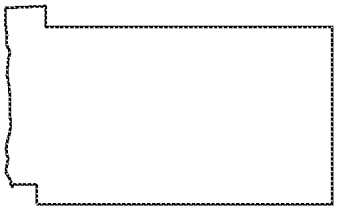
Figure 8E:
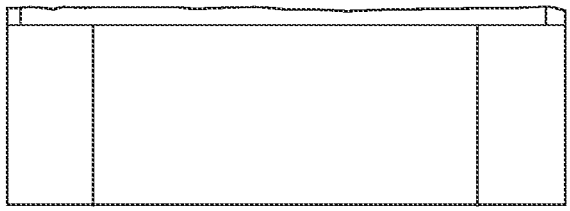
Figure 8F:
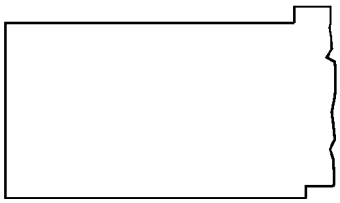
Figure 8G:
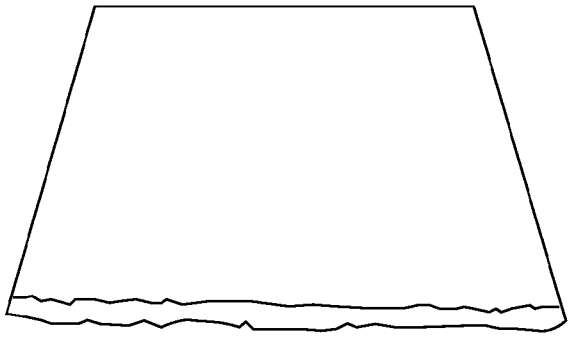
Figure 9A:
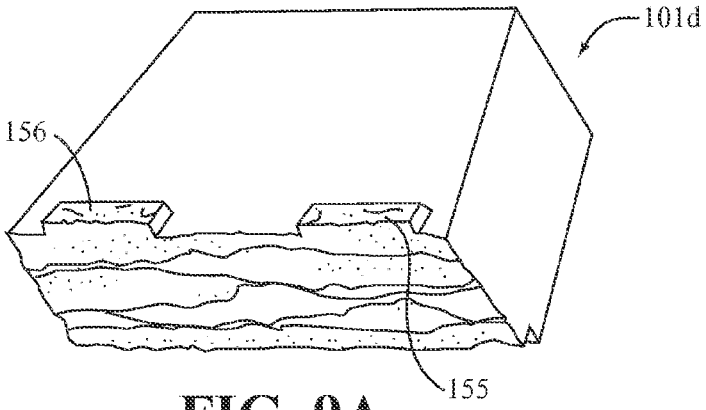
FIGS. 9A, 9B, 9C, 9D, 9E, 9F and 9G are perspective, top, front, right side, back, left side and bottom views, respectively, of a forth block according to a first embodiment of a multiple block system in accordance with the present invention.
Figure 9B:
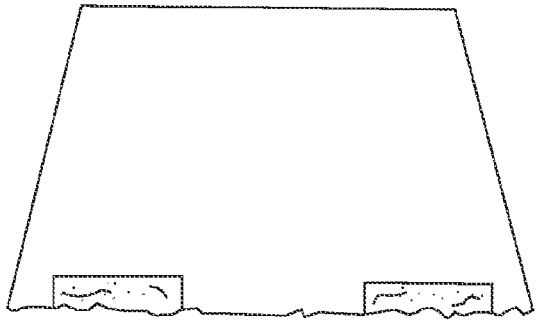
Figure 9C:
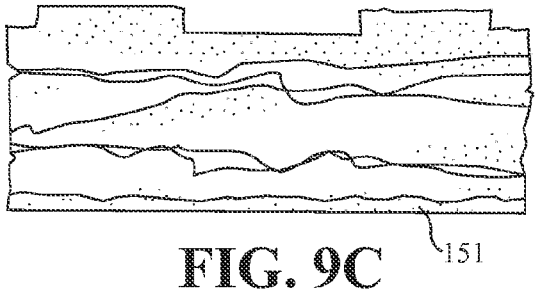
Figure 9D:
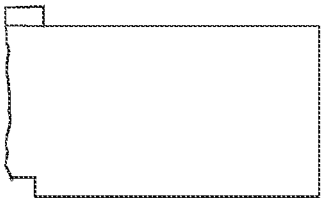
Figure 9E:
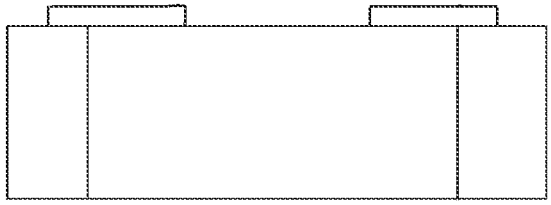
Figure 9F:
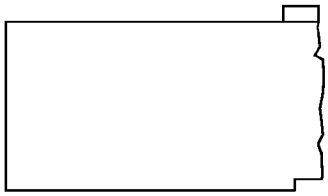
Figure 9G:
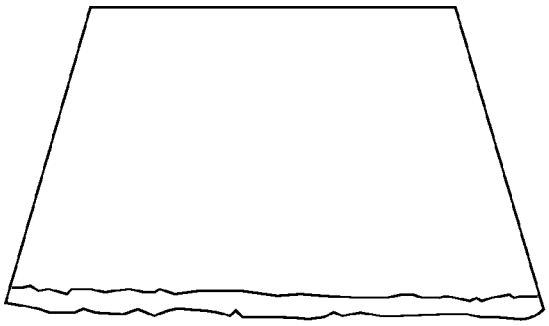

A second embodiment of the single block system is shown in FIGS. 4 and 5. Block 1*b* is similar in all respects to block la except that the front face 6*b* is provided with an ashlar surface pattern instead of the ledgestone pattern of front face 6*a*. The description of the various features of block 1*a* and the construction of a retaining wall therefrom are applicable with respect to block 1*b* and will not be repeated. The only significant difference between blocks 1*a* and 1*b* is the front face contour and the appearance which is created when the blocks are used to construct a retaining wall.

A retaining wall constructed with blocks 1*b* is shown in FIG. 5. In accordance with the discussion regarding the manufacture of block 1*a* with up to four different surface configurations FIG. 5, for purposes of illustration, shows a partial retaining wall constructed from blocks 1*b* showing only the surface configurations of four potential surface contours of block 1*b*. Construction of the wall in its intended manner results in portions 26 of the channels of block 1*b* being exposed. In this embodiment in order to camouflage any regular pattern of exposed portions 26 the front faces 6*b* of the blocks are provided with recesses 22*b*. These recesses can be either horizontal or vertical or both and are provided at a depth which mimics the appearance of exposed portions 26. This effectively camouflages any regular pattern formed by exposed portions 26 and provides a pleasing variable or random appearance to the surface of the wall.

An additional benefit of the one block systems is that it facilitates the construction of walls that are curved. Because the wall uses both a lip and recess, the amount of set back is limited. In addition, because the lip only extends across a portion of the center of the block, there is less of a tendency for the succeeding courses to bind and to go into a negative batter during the construction of inside curves.

Multiple Wall Block System

A multiple wall block system is shown in FIGS. 6 to 16. The multiple wall block system is similar to the single wall block system described above except that the system comprises two or more blocks, each having one or more upper lips and one or more lower channels which are dimensioned and/or positioned differently. This difference in the number and/or location of the lips and channels results in several advantages. First, the randomness of the size and spacing of lips and channels insures that when a wall is constructed from the blocks any exposed portions of the channels do not form a regular pattern. Second, additional flexibility with respect to building curved walls with the blocks is provided. Due to the variety of lip sizes and placements, the wall can be built in a fashion that allows the wall builder to select units that allow the construction of curved walls with minimal variation from the pre-designed amount of set back, which enhances the stability and aesthetic characteristics of the finished wall and eases construction. The multiple wall block system comprises a first embodiment of first, second, third and fourth blocks as disclosed in FIGS. 6A-6G, 7A-7G, 8A-8G, and 9A-9G, respectively in a ledgestone pattern. A second embodiment of those blocks is shown in FIGS. 12A-12G, FIGS. 13A-13G, FIGS. 14A-14G, and FIGS. 15A-15G in an ashlar pattern. Each of these block embodiments is similar to the block embodiments described with respect to the single block wall system except for the variation in placement and location of the lips and the provision of a single continuous channel which comprise the face connection system. Therefore this description will focus primarily on the varying aspects of the front face connection system.

The first block of the multiple wall block system is shown in FIGS. 6A-6G. Block 101*a* has a top surface 102 which is substantially parallel to a bottom surface 103, nonparallel first and second side wall surfaces 104 and 105 and a front face 106*a* which is substantially parallel to a rear surface 107. The front face 106*a* and rear surface 107 each extent from top surface 102 to bottom surface 103. First and second side surfaces 104 and 105 extend from top surface 102 to bottom surface 103 and from front face 106*a* to rear surface 107. The top and bottom surfaces, side surfaces, front face and rear surface collectively define a block body. Block 101*a* is generally symmetrical about a vertical plane of symmetry. As discussed with respect to block 1*a* the size and shape of block 101*a* may be varied considerably within the scope of the invention.

As mentioned previously, block 101*a* is similar to block 1*a* except for the details of the face connection system. Specifically, block 101*a* includes a centrally located lip 150 and a continuous bottom channel 151.

The second block of the multiple wall block system is shown in FIGS. 7A-7G. Block 101*b* is similar to block 101*a* in all respects except that instead of a single centrally located lip the block of 101*b* comprises lips 152 and 153 which are spaced apart and located adjacent the sides of block 101*b*.

The third block of the multiple wall block system is shown in FIGS. 8A-8G. This block is similar to block 101*a* in all respects except that it has a single continuous lip 154 which extends the width of the block along front face 106*c*.

The fourth block of the multiple wall block system is shown in FIGS. 9A-9G. Block 101*d* is similar to block 101*a* except that it has randomly spaced lips 155 and 156.

Figure 10:
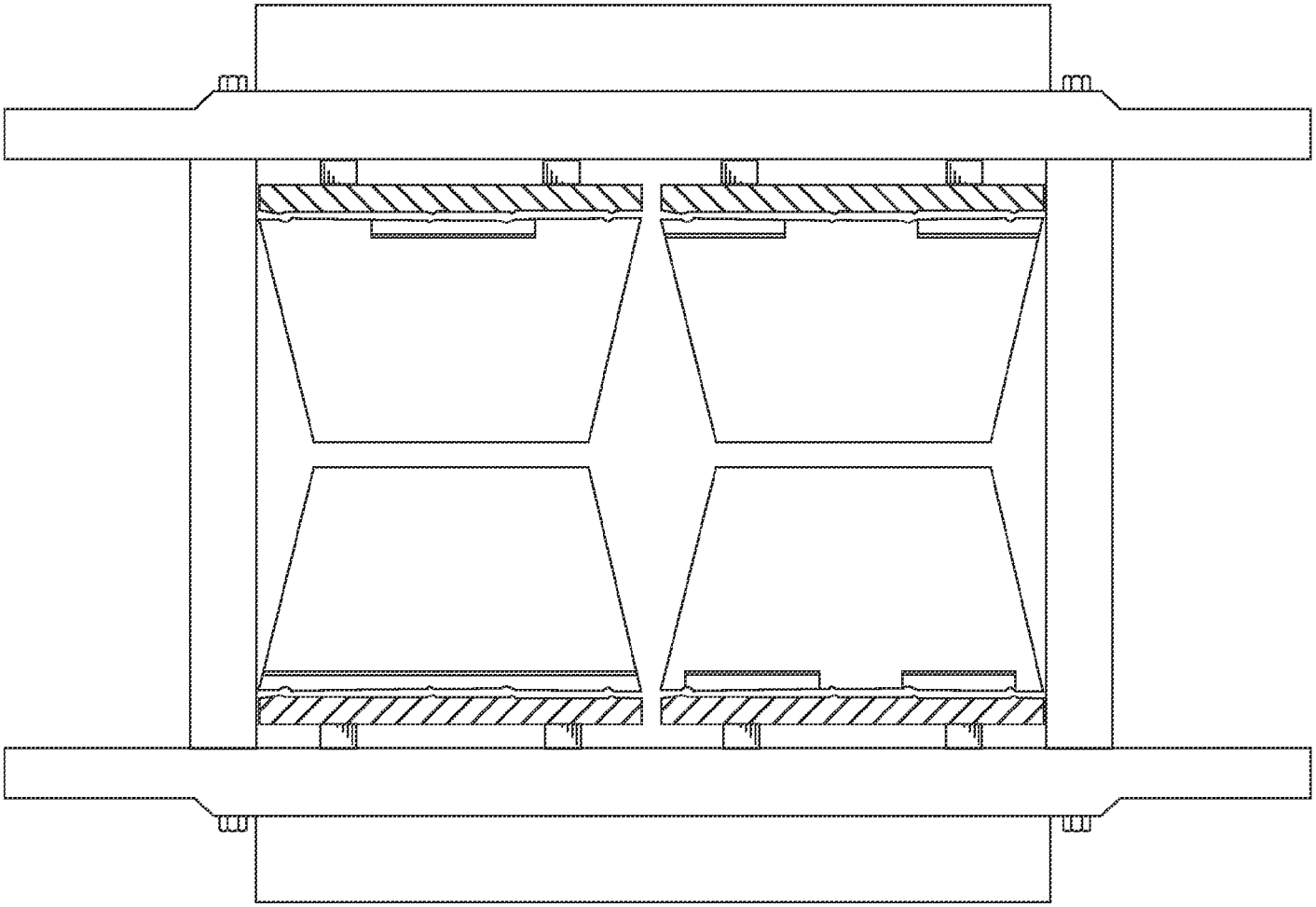
FIG. 10 is a plan view of a mold box used for forming the first, second, third and fourth blocks of the multiple block system.
Figure 11:
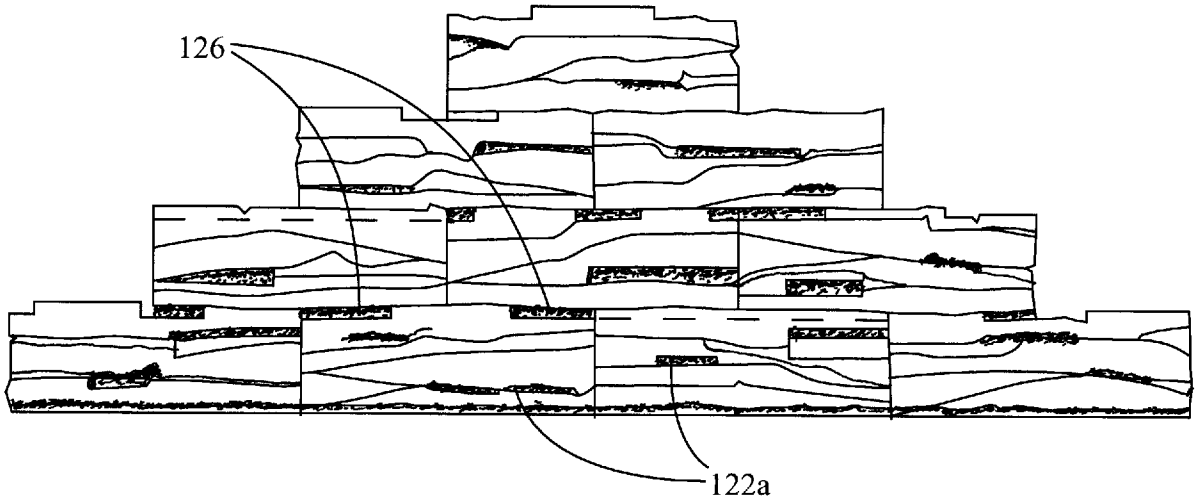
FIG. 11 is a front view of a portion of a retaining wall constructed with the blocks of FIGS. 6, 7, 8 and 9.
Figure 12A:
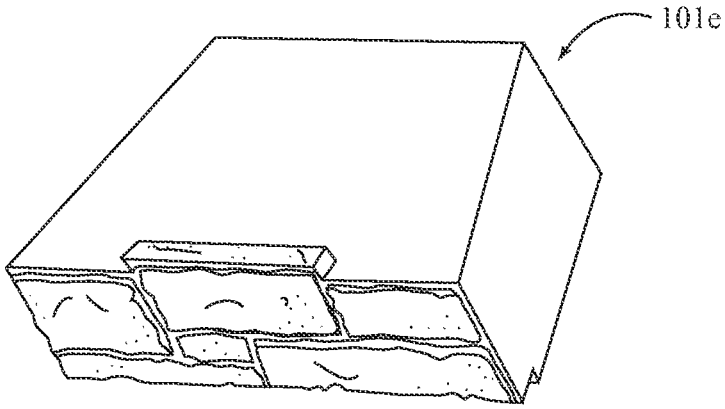
FIGS. 12A, 12B, 12C, 12D, 12E, 12F and 12G are perspective, top, front, right side, back, left side and bottom views, respectively, of a first block according to a second embodiment of the multiple block system.
Figure 12B:
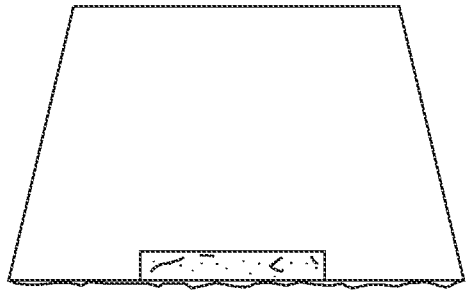
Figure 12C:
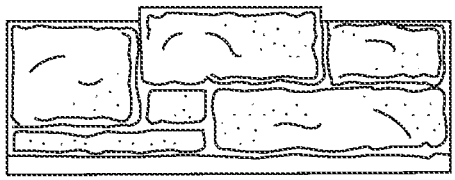
Figure 12D:
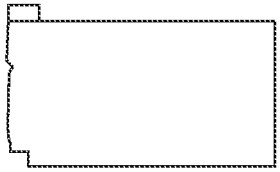
Figure 12E:
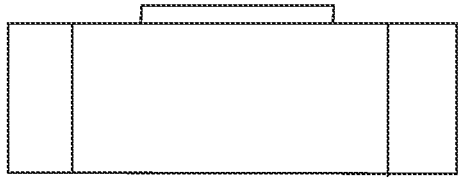
Figure 12F:
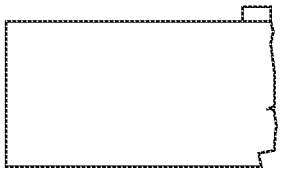
Figure 12G:
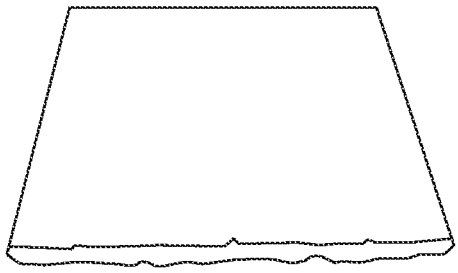
Figure 13B:
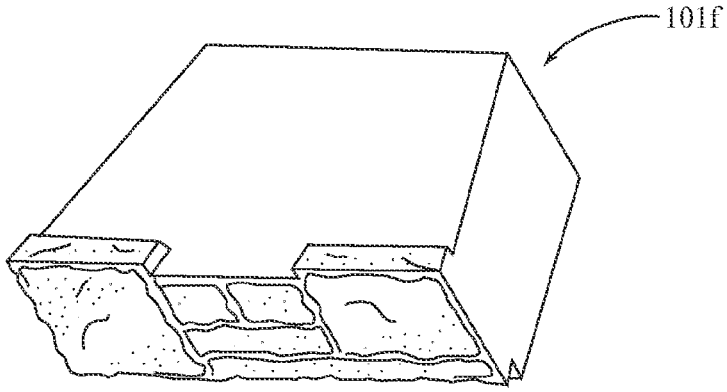
FIGS. 13A, 13B, 13C, 13D, 13E, 13F and 13G are perspective, top, front, right side, back, left side and bottom views, respectively, of a second block according to a second embodiment of the multiple block system.
Figure 13A:
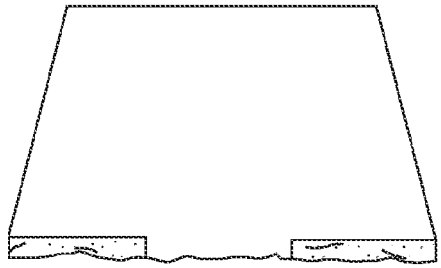
Figure 13C:
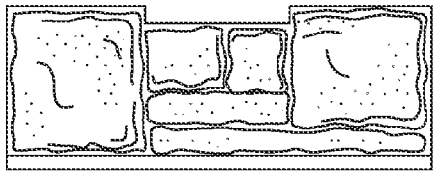
Figure 13D:
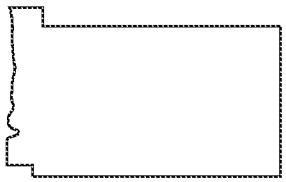
Figure 13E:
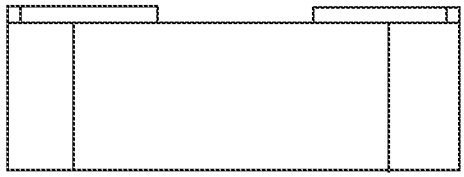
Figure 13F:
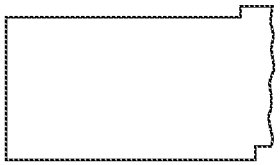
Figure 13G:
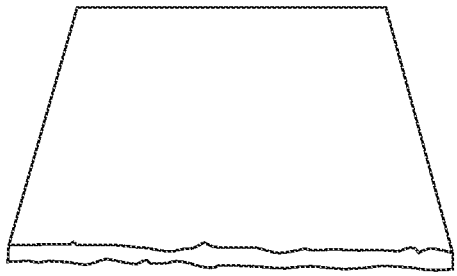
Figure 14A:
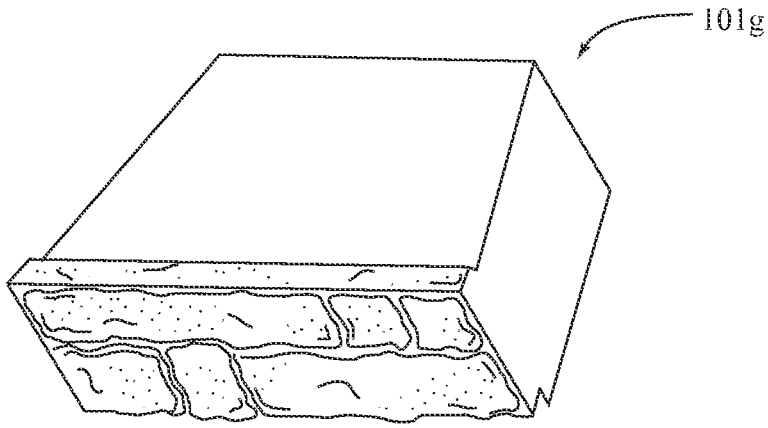
FIGS. 14A, 14B, 14C, 14D, 14E, 14F and 14G are perspective, top, front, right side, back, left side and bottom views, respectively, of a third block according to a second embodiment of the multiple block system.
Figure 14B:
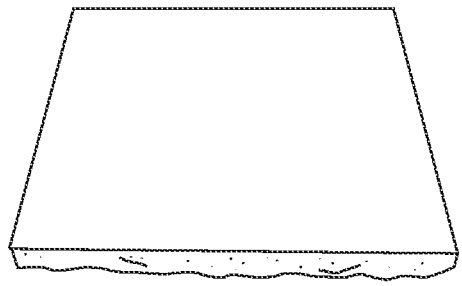
Figure 14C:
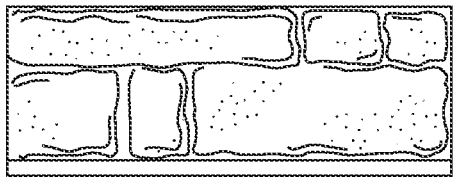
Figure 14D:
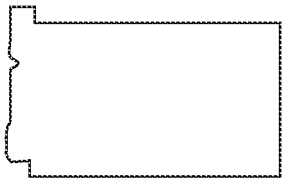
Figure 14E:
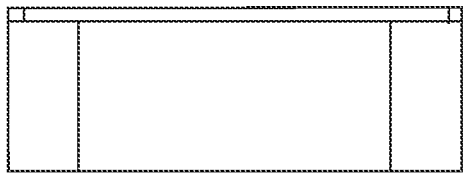
Figure 14F:
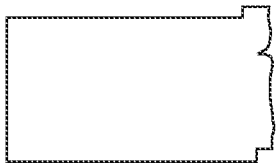
Figure 14G:
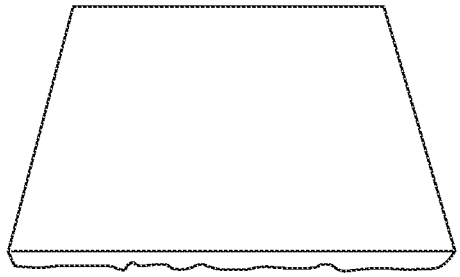
Figure 15A:
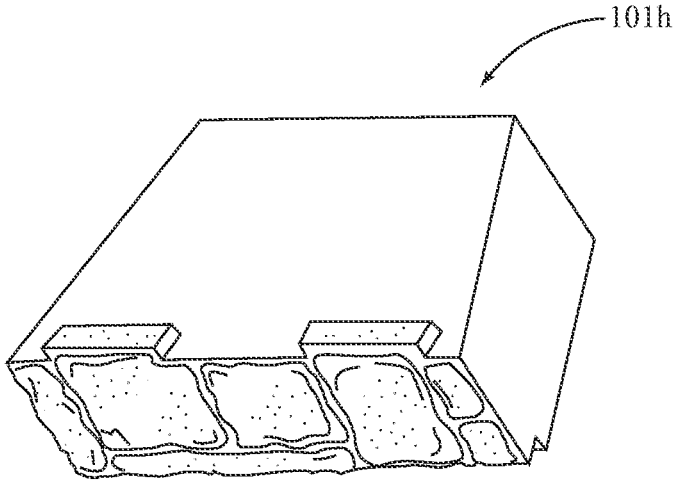
FIGS. 15A, 15B, 15C, 15D, 15E, 15F and 15G are perspective, top, front, right side, back, left side and bottom views, respectively, of a fourth block according to a second embodiment of the multiple block system.
Figure 15B:
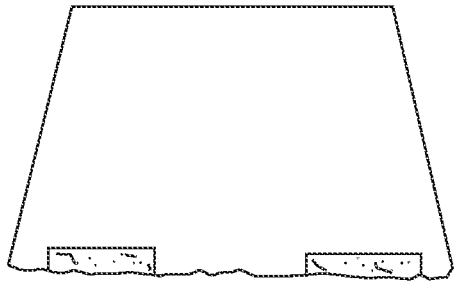
Figure 15C:
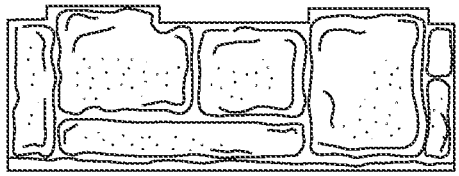
Figure 15D:
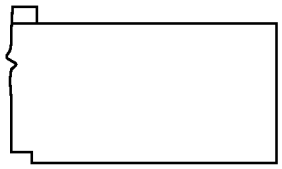
Figure 15E:
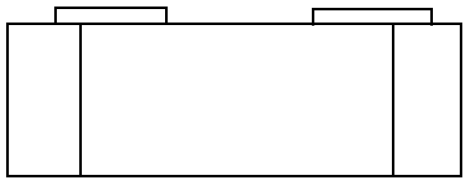
Figure 15F:
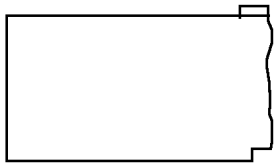
Figure 15G:
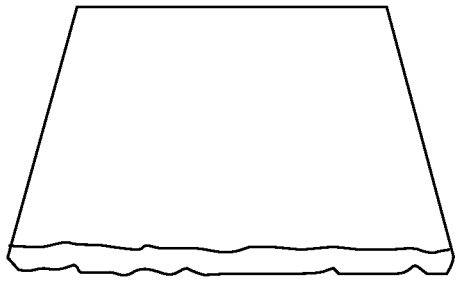

The blocks may be formed by any conventional process known in the art. For example, the blocks may be made using dry cast concrete block making equipment or may be formed by use of a wet cast molding process, both of which are known in the art. One manner of making blocks 101*a*, 101*b*, 101*c* and 101*d* of the multiple wall block system is to form them in a mold as shown in FIG. 10. The mold will allow multiple units to be made. There can be any combination of different units. A commonly known concrete block manufacturing machine is used to produce the blocks. Typical machines are manufactured by Besser, Columbia or Tiger. A mold (open at both top and bottom) is placed in the machine at the beginning of a production run of the blocks of the present invention. A manufacturing pallet is placed underneath the mold, and forms the bottom of the block. The top of the block is formed by a stripper shoe. In one cycle of a continuous process, the mold is filled with concrete, the concrete is compacted and vibrated, and the blocks are stripped from the mold onto the manufacturing pallet that forms the bottom of the block. The top of the block is formed by an indented portion of the stripper shoe that compacts the concrete mix, and at the appropriate stage, strips the blocks from the mold down onto the manufacturing pallet. The blocks are then delivered to a curing area, cured, and then cubed onto delivery pallets. The method of constructing a retaining wall with blocks 101*a*, 101*b*, 101*c* and 101*d* is similar to that described with respect to the single block system except that the various block styles are utilized randomly to achieve a varied and visually appealing surface texture for the wall. As is well known in the art, a trench is excavated to allow the placement of a base leveling pad of well compacted gravel or road base. The base course of the wall units is placed and leveled along the desired contour of the wall. Typically, varying the type of wall unit so that a variety of patterns are adjacent to one another is desirable to enhance the random, natural stone appearance of the wall. A second course is place above the base course by placing the wall blocks so that the lips of the first course blocks engage the recesses of the second course blocks, and again by selecting a random pattern of block types to enhance the natural appearance of the wall. Succeeding courses are placed in the same manner until the desired wall height is reached. If a curve is constructed, the wall builder may elect to choose blocks with center lips to minimize set back variation. If the wall is tall enough, reinforcement with geogrid, as is well known in the art, may be employed. Construction of a wall with the multiple wall block system as with the single wall block system results in exposing portions 126 of channels. However, because the connection system comprises blocks with a continuous bottom channel but varied lip placement and size the net effect is that no regular pattern of exposed portions 126 is formed. In addition, texturing the back wall of the recesses enhances the natural appearance of these joints in the wall. The random effect of exposed portions 126 is even further enhanced and camouflaged by providing in the block surfaces recesses 122*a* which are designed to resemble the appearance of the recesses that receive the connector lips.

As mentioned previously, a second embodiment of the multiple wall block system is disclosed in FIGS. 12-16. In this embodiment blocks 101*e* (FIGS. 12A-12G), 101*f* (FIGS. 13A-13G), 101*g* (FIGS. 14A-14G) and 101*h* (FIGS. 15A-15G) correspond to blocks 101*a-d*, respectively, except that the front surface of the blocks has an ashlar surface pattern instead of a ledgestone pattern. In all other respects the blocks are the same and the description set forth previously is equally applicable to these blocks.

Figure 16:
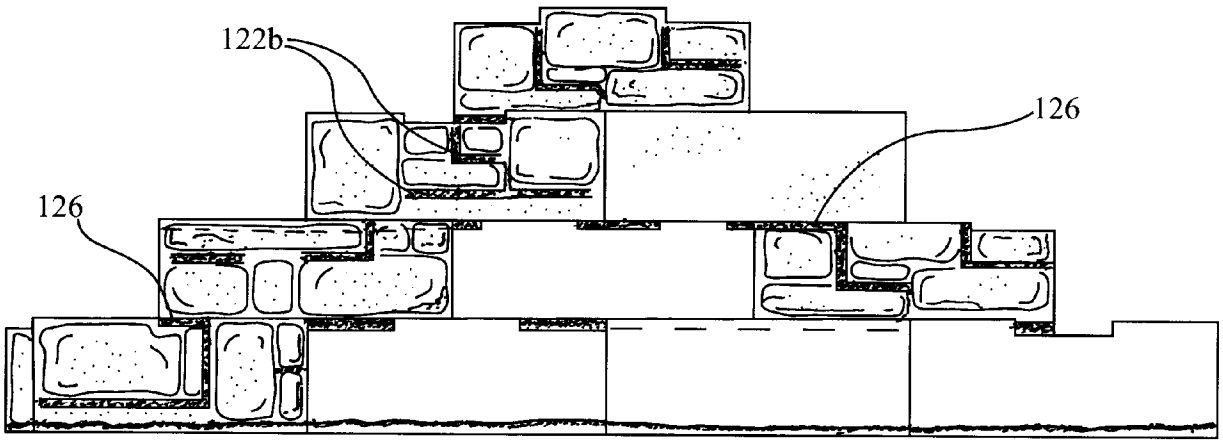
FIG. 16 is a front view of a portion of a retaining wall constructed with the first, second, third and fourth blocks shown in FIGS. 12, 13, 14 and 15, respectively.

A retaining wall constructed with blocks 101*e*, 101*f*, 101*g* and 101*h* is shown in FIG. 16. The construction is similar to that described with respect to FIG. 11 except that the irregular pattern of exposed portions 126 are further camouflaged by providing recesses 122*b* in the front faces of the blocks. These recesses can either be horizontal or vertical or both and are provided at a depth which mimics the appearance of exposed portions 126. The recesses would be in the areas where grout joints would be found in a traditional ashlar wall. The combination of eliminating regular horizontal lines between succeeding courses of the blocks, providing irregularly spaced lips on the top of each block, and mimicking the irregular appearance of the horizontal joints on the main face of the blocks all contribute to camouflage the horizontal joints and create a visual impression of a true ashlar wall, while using wall blocks that lay out in continuous horizontal layers, as opposed to the varying levels of an ashlar wall, which greatly complicates construction, since the builder must make individual pieces fit.

What is claimed is:

1. A wall block comprising:

a block body including a top surface, a bottom surface and a front face, the front face having an exposed surface and at least one recessed surface; and at least one lip extending from the top surface, the at least one lip having first and second ends, first and second lateral surfaces and an upper surface, one of the lateral surfaces forming a part of the exposed surface of the front face, the at least one lip having a length measured between the first and second ends, a total number of the at least one lip not being equal to a total number of the at least one recessed surface;

wherein the at least one recessed surface is formed into the bottom surface and front face, the at least one recessed surface being set back from the exposed surface of the front face into the block body, the at least one recessed surface being sized such that when a wall is formed from a plurality of the blocks stacked in multiple courses the at least one recessed surface will accommodate at least one lip from an adjacent block in a lower course and wherein the at least one recessed surface engages a lateral surface of the at least one lip from the adjacent block in the lower course.

2. The wall block of claim 1 wherein the first and second sides are nonparallel.

3. The wall block of claim 1 wherein the total number of the at least one lip is one and the total number of the at least one recessed surface is two.

4. The wall block of claim 3 wherein the length of the one lip is greater than a length of each of the two recessed surfaces.

5. The wall block of claim 1 wherein the total number of the at least one lip is two and the total number of the at least one recessed surface is one.

6. The wall block of claim 1 wherein the block body includes opposing first and second side surfaces and wherein the exposed surface of the front face has two or more vertically orientated surfaces, at least one vertically orientated surface extending from the first side surface to the second side surface of the block body.

7. The wall block of claim 6 wherein at least one vertically orientated surface of the exposed surface of the front face is closed to the first and second side surfaces of the block body.

8. A wall block system comprising:

a plurality of blocks including first and second blocks, each block having a block body including a top surface, a bottom surface and a front face having an exposed surface and at least one recessed surface, each block further having at least one lip extending from the top surface, the at least one recessed surface being formed into the bottom surface and front face, the at least one recessed surface being set back from the exposed surface of the front face into the block body, the at least one lip having first and second ends, first and second lateral surfaces and an upper surface, one of the lateral surfaces forming a part of the front face, the at least one lip having a length as measured between the first and second ends, a total number of the at least one lip not being equal to a total number of the at least one recessed surface;

the at least one recessed surface being sized such that when a wall is formed from the plurality of blocks stacked in multiple courses at least a portion of the at least one lip of the first block positioned in a first course will be accommodated in the at least one recessed surface of the second block in a second course overlying the first course and wherein the at least one recessed surface of the second block in a second course engages a lateral surface of the at least one lip from the first block positioned in a first course.

9. The wall block system of claim 8 wherein the total number of the at least one lip is one and the total number of the at least one recessed surface is two.

10. The wall block system of claim 9 wherein the length of the one lip is greater than a length of each of the two recessed surfaces.

11. The wall block system of claim 8 wherein the block body includes opposing first and second side surfaces and wherein the exposed surface of the front face has two or more vertically orientated surfaces, at least one vertically orientated surface extending from the first side surface to the second side surface of the block body.

12. The wall block system of claim 11 wherein at least one vertically orientated surface of the exposed surface of the front face is closed to the first and second side surfaces of the block body.

13. A retaining wall system comprising:

a plurality of block types including a first block type and a second block type, each block type having a block body including a top surface, a bottom surface and a front face having an exposed surface and at least one recessed surface, each block type further having at least one lip extending from the top surface, the at least one recessed surface being formed into the bottom surface and front face, the at least one recessed surface being set back from the exposed surface of the front face into the block body, the at least one lip having first and second ends, first and second lateral surfaces and an upper surface, one of the lateral surfaces forming a part of the front face, the at least one lip having a length as measured between the first and second ends, at least one of the first block type and second block type having a total number of the at least one lip not being equal to a total number of the at least one recessed surface and wherein the at least one recessed surface of each block type in an upper course of the retaining wall engages the lateral surface of the at least one lip from each block type in a lower course of the retaining wall.

14. The retaining wall system of claim 13 further comprising a third block type and a fourth block type.

15. The retaining wall system of claim 13 wherein at least one of the first block type and second block type has a total number of the at least one lip being equal to a total number of the at least one recessed surface.

16. The retaining wall system of claim 13 wherein the total number of the at least one lip is one and the total number of the at least one recessed surface is two for at least one of the first block type and second block type.

17. The retaining wall system of claim 16 wherein the length of the one lip is greater than a length of each of the two recessed surfaces.

18. The retaining wall system of claim 13 wherein the block body of the first block type and second block type each include opposing first and second side surfaces and wherein the exposed surface of the front face of at least one of the first block type and second block type has two or more vertically orientated surfaces, at least one vertically orientated surface extending from the first side surface to the second side surface of the block body.

19. The retaining wall system of claim 18 wherein at least one vertically orientated surface of the exposed surface of the front face of at least one of the first block type and second block type having two or more vertically orientated surfaces is closed to the first and second side surfaces of the block body.

20. The retaining wall system of claim 13 wherein the retaining wall includes a visible front surface and wherein the exposed surface of the front face of the first block type and second block type and at least one portion of at least one recessed surface of at least one of the first block type and second block type form the visible front surface of the retaining wall.

* * * * *